United States Patent [19]

Sasaki

[11] 3,949,801

[45] Apr. 13, 1976

[54] DEVICE FOR AUTOMATICALLY CLOSING A FOLDING DOOR

[76] Inventor: Giichi Sasaki, 17-37, Yotsuihon, Fukui, Japan

[22] Filed: Nov. 29, 1974

[21] Appl. No.: 528,174

[52] U.S. Cl. ..... 160/229 R; 160/213; 16/75

[51] Int. Cl.[2] ..... E05D 15/00

[58] Field of Search ..... 160/229, 213, 224, 231, 160/232; 16/75, 180, 182; 49/379, 386

[56] References Cited

UNITED STATES PATENTS

| | | | |
|---|---|---|---|
| 1,483,809 | 2/1924 | Hull | 49/386 |
| 2,374,925 | 5/1945 | Corso | 160/213 |
| 3,067,453 | 12/1962 | Lyons | 49/386 |
| 3,092,870 | 6/1963 | Baer | 16/180 |
| 3,438,152 | 4/1969 | Cadiou | 16/75 |
| 3,456,388 | 7/1969 | Hanson et al. | 49/386 |
| 3,592,289 | 7/1971 | Aysta et al. | 160/231 |
| 3,800,328 | 3/1974 | Harlan et al. | 49/386 |

*Primary Examiner*—Paul R. Gilliam
*Assistant Examiner*—Victor N. Sakran
*Attorney, Agent, or Firm*—Allison C. Collard

[57] ABSTRACT

In a door which is openable by being folded into two or more sections, a device which makes it possible to extend the folds automatically and noiselessly to close the door in such a manner that a series of extended folds look like one closed door when a finger tip pressure on the door for opening it has been released. In so doing, no additional automatic closing device such as a door check or a floor hinge is required.

4 Claims, 6 Drawing Figures

DEVICE FOR AUTOMATICALLY CLOSING A FOLDING DOOR

This invention relates to a device for automatically closing a folding door in a space much smaller than normally required for opening and closing a conventional single panel door.

In conventional single panel doors, they are usually attached by means of hinges to the frame work at the entrance of a room and also require the use of hinges and a door check. A single panel door also requires that floor space be provided in the room where the door swings open so that there is a loss of useable floor space in the area where the door is mounted.

Accordingly, the present invention provides a folding door having a plurality of foldable panels which contain a hinge portion which are joined together by a coupling having torsion bars which automatically urge the door in a closed position when the door is released.

It is therefore an object of the present invention to provide a device for automatically closing a folding door in a space smaller than normally required for opening and closing a conventional single panel door.

A second object of this invention is to provide a device for automatically closing a folding door without being required to be provided with a door check or hinges.

A third object of this invention is to provide a device for closing a folding door noiselessly without the requirement for any other apparatus.

A fourth object of this invention is to provide a device which has an attractive appearance.

A fifth object of this invention is to provide a device which is simple in construction and which is easy to manufacture.

Other objects and features of the present invention will become apparent from the following detailed description when taken in connection with the accompanying drawings which disclose several embodiments of the invention. It is to be understood that the drawings are designed for the purposes of illustration only, and are not intended as a definition of the limits and scope of the invention disclosed In the drawings, wherein similar reference numerals denote similar elements throughout the several views.

Figure 1:
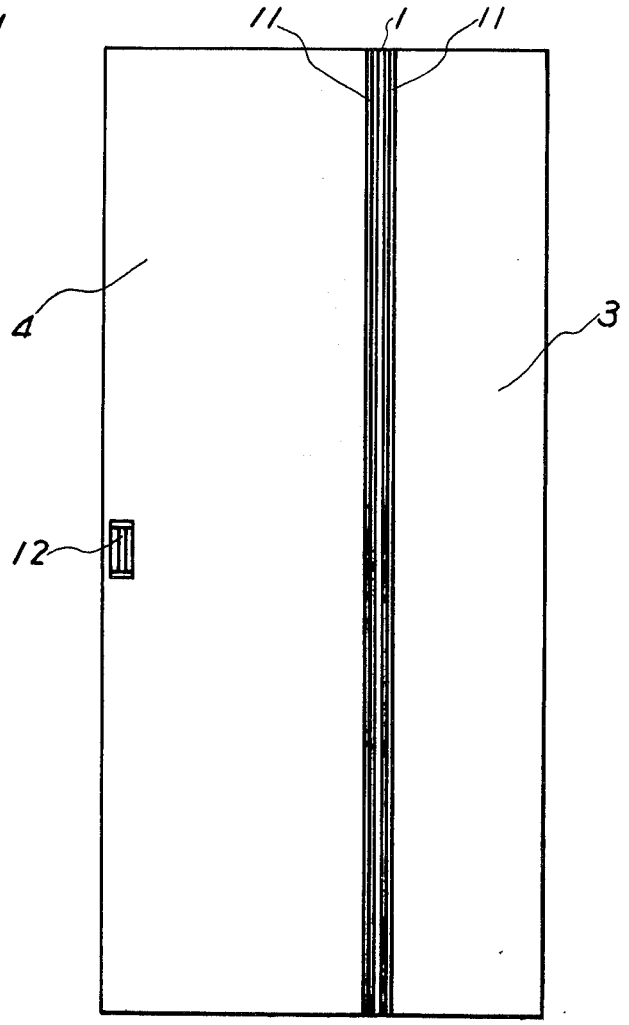
FIG. 1 is a front elevation of a two panel door of the invention when it is closed.
Figure 4:
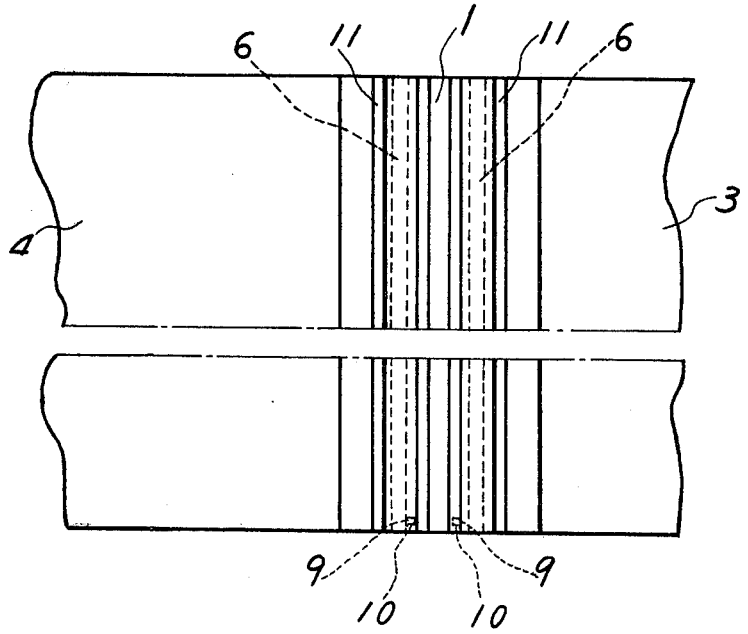
FIG. 4 is an enlarged front elevation view of the essential elements of a connecting member.
Figure 2:
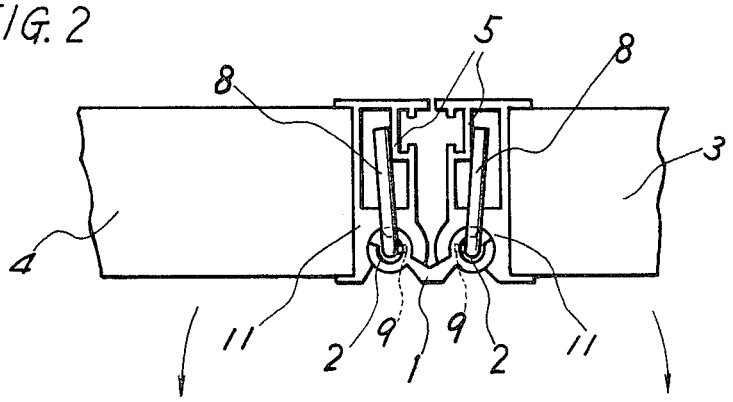
FIG. 2 is a plan view of the essential elements of the invention when the door is closed.

A conventional single panel door is usually attached to a framework at an entrance. It moves pivotally in one direction to open it. Thus, it is necessary to provide a floor space beforehand which is equivalent to the space within which the single panel door will move pivotally. This means a loss of usable floor space in the room. This is very uneconomical from the standpoint of floor utilization.

Moreover, in order to close the conventional single panel door, it is necessary that the door be equipped with an automatic closing device such as a door check and a hinge, the installation of which may require a considerable amount of money. This means that the conventional single panel door has an additional disadvantage in that it requires a higher installation cost.

This invention removes all these disadvantages by providing a folding door consisting of a plurality of foldable panels. An elastic axial bar is provided in a folded panel portion. The repulsive power of the axial bar allows the folded panel portion to extend itself to its original state of being a board quite smoothly and noiselessly, so that the door is closed.

Since the folding door of this invention is capable of being opened and closed within a space much smaller than a space required for the conventional single panel door, it has an effect of enlarging usable floor space. Moreover, since the folding door of this invention does not require a door check or hinges, it has an effect of performing an automatic closing at a lower cost.

Referring to the drawings, a connecting member or coupling 1 has a length equal to the length of the door, and longitudinal holes 2,2 for an axial bar near its both sides. Panels 3 and 4 constitute a door, consisting of an interior side panel, and an exterior side panel. Near the connecting end portions of panels 3 and 4 are provided suspending members 5,5 respectively. Axial bars 6,6 are made of solid and elastic metallic wire such as piano wire, and consists of longitudinal portions 7,7 extending through holes 2,2 over practically its entire length in a vertical direction. Bars 6,6 also have transverse bar portions 8,8 which are made by curving the upper ends of longitudinal portions 7,7 at right angles on the top surface of panels 3 and 4. Radial projections 9,9 are provided respectively on the lower sides of the longitudinal bars 7,7. Projections 9,9 are inserted and fixed respectively in holding holes 10,10 provided in a lower portion of longitudinal holes 2,2. Furnishing members 11,11 are provided along the respective joints of panels 3 and 4. Standing face to face with the lower portions of the respective transverse bar portions 8,8 are provided suspending members 5,5. The respective portions of transverse bar portions 8,8 are suspended by suspending members 5,5 of panels 3 and 4.

Figure 3:
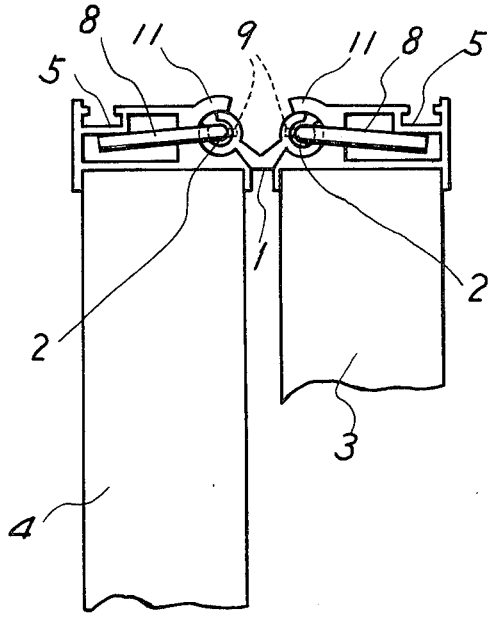
FIG. 3 is a plan view of the essential elements of this device when the door is open.
Figure 5:
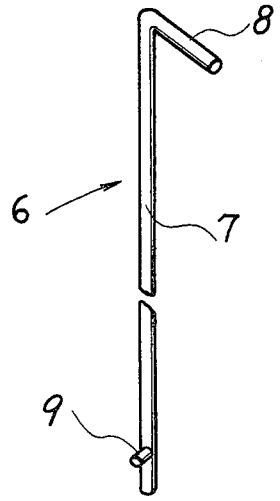
FIG. 5 is a side elevation of an axial bar.
Figure 6:
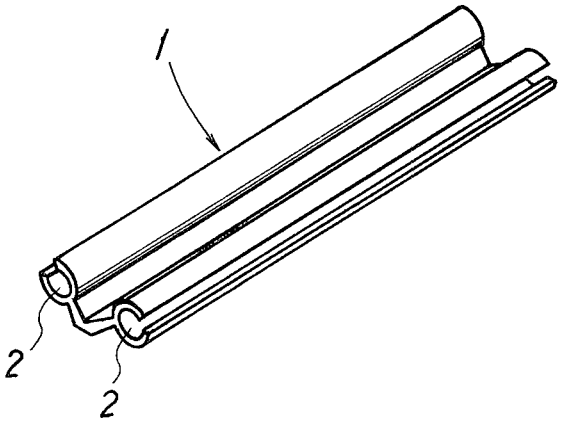
FIG. 6 is an oblique view of the connecting member.

In operation, one holds a handle 12 and pulls the outside panel 4. The respective tips of transverse bar portions 8,8 are then pressed by the respective members 5,5 provided on furnishing members 11. The longitudinal portion of axial bars 6,6 are twisted as the door is pushed in the direction of the arrows. The connecting member 1 serves as an axis as panels 3 and 4 are folded together. The folded panels are located on the interior side of the door as shown in FIG. 3, and thus the door is opened.

In this case, projections 9,9 on the respective lower sides of axial bars 6,6 go into the inside of holding holes 10,10. Thus, the lower portions of axial bars 6,6 are kept stationary even though their uppermost portions, transverse bars 8,8, are being pressed down in the direction of the arrows as mentioned above. In opening the door by the two opposing forces, axial bars 6,6 which have a restoring force from the previous state of being forcibly twisted, will open the door in a double-folded state. In other words, when the door is closed, projections 9,9 are at right angles with transverse bar portions 8,8. When the door is open, however, axial bars 6,6 are twisted so that the projections may be in parallel with the transverse bar portions, as can be seen from FIG. 3.

When the door is opened at a predetermined amount, and handle 12 is released, the pressing power will disappear. The repulsive force due to the twisted state created previously in axial bars 6,6 begins to operate to move the tips of transverse bar portions 8,8 in a direction opposite to the direction of the arrows, thereby pressing down suspending members 5,5 in the opposite direction, and allows panels 3 and 4 to be in a flat state or in a closed door state. Thus, the door is closed automatically and smoothly.

The invention reduces a space required for opening or closing a door and when compared with a conventional single panel door, it enlarges the usable area of the floor. Moreover, with the operation of simple axial bars with neither a floor hinge nor a door check, the door may be closed automatically and noiselessly.

While only a single embodiment of the present invention and been shown and described, it will be obvious to those skilled in the art that many changes and modifications may be made thereunto without departing from the spirit and scope of the invention.

What is claimed is:

1. A device for automatically closing a folding door having at least two sections comprising:

a furnishing member secured to an edge defining the joint of each door section;

a coupling pivotably joining each of said furnishing members and defining a pair of longitudinal holes through said coupling along the length of each door section; and a torsion bar inserted into each hole of said coupling and having a radial projection adjacent to one end engaging said coupling, and a transverse bar portion at its opposite end freely contacting said furnishing member so that when the door sections are pivoted open, said torsion bars are twisted between each transverse bar portion and each projection to create a torsional stress in each of said torsion bar so that when said door sections are closed, the torsional stress of each of said torsion bar will automatically close said door.

2. The device as recited in claim 1 wherein each of said furnishing members includes a partial longitudinal hole for receiving the axis of said coupling.

3. The device as recited in claim 2 wherein each of said furnishing members includes a suspending member suspending the transverse bar portion of each of said torsion bars.

4. The device as recited in claim 1 wherein each of said torsion bars are constructed of metallic wire.

* * * * *